US005303601A

United States Patent [19]

Schönberger et al.

[11] Patent Number: 5,303,601

[45] Date of Patent: Apr. 19, 1994

[54] TORQUE WRENCH

[75] Inventors: Heinz Schönberger; Frank Humme, both of Solingen; Peter Wirtz, Remscheid, all of Fed. Rep. of Germany

[73] Assignee: Saltus-Werk Max Forst GmbH & Co., Solingen, Fed. Rep. of Germany

[21] Appl. No.: 806,903

[22] Filed: Dec. 12, 1991

[30] Foreign Application Priority Data

Dec. 13, 1990 [DE] Fed. Rep. of Germany ..... 4039794

[51] Int. Cl.[5] ..... G01L 5/00

[52] U.S. Cl. ..... 73/862.23; 73/862.21

[58] Field of Search ..... 73/3 C, 862.21, 862.23, 73/862.22

[56] References Cited

U.S. PATENT DOCUMENTS 4,125,016 11/1978 Lehoczky et al. ..... 73/862.23
4,669,319 6/1987 Heyraud ..... 73/862.23

FOREIGN PATENT DOCUMENTS 0133557 2/1985 European Pat. Off. .
0172120 2/1986 European Pat. Off. .
0210892 2/1987 European Pat. Off. .

*Primary Examiner*—Richard E. Chilcot, Jr.
*Assistant Examiner*—R. Biegel
*Attorney, Agent, or Firm*—Martin A. Farber

[57] ABSTRACT

The present invention relates to a torque wrench (1, 2) having an electronic measuring device which detects a prevailing torque by means of strain gauges, having a memory for the storing of measured values and an indicating device which indicates the minimum and maximum values reached by means of light-emitting diodes (5, 6, 7) of different color. In order to be able to use the torque wrench advantageously, in particular in routine work where the precise maintaining of a torque is of importance, the invention proposes that a measured value be stored by actuating an actuating button (8) which also serves to activate the torque wrench (1, 2).

8 Claims, 5 Drawing Sheets

TORQUE WRENCH

FIELD AND BACKGROUND OF THE INVENTION

The present invention relates to a torque wrench provided with electronic measurement and indication of torque by strain gauges in a bridge circuit arrangement.

Such torque wrenches are already known in various embodiments. Reference is had in this connection, merely by way of example, to U.S. Pat. Nos. 3,970,155, 4,006,629 and 4,522,075. Furthermore, such a torque wrench is known from French Patent 2 497 347.

The known torque wrenches have the fact in common that they are not yet satisfactory for use with the least possible problems in manufacture, and in installation or maintenance work. Thus, on the one hand, the excessive weight of such torque wrenches is criticized. Furthermore, verification as to whether the torque applied has reached the desired value is not always simple. It is furthermore also desirable to obtain a verification of the work in order to be able to determine whether the desired torques have in each case actually been applied.

SUMMARY OF THE INVENTION

Starting from the above mentioned prior art as known in particular from the French patent, it is therefore the object of the invention to provide a torque wrench which can be advantageously used, in particular, for routine work in which it is important precisely to maintain a given torque.

According to the invention a memory is provided for storing measured values as well as a device for indicating a desired torque range, in which connection a measured torque can be indicated merely with respect to whether it reaches or exceeds the preset range, and in which connection furthermore a change in the setting of the wrench can be effected merely upon connection to a separate programming device. In accordance with the invention, all devices for changing the wrench setting and for the detailed indication of the measured values have been removed from the wrench. Via an interface to a programming device, these data can however be entered in the wrench, or a setting of the wrench can be changed. Furthermore, the measured values which are in themselves stored digitally, can be accurately read via this interface. The user of the torque wrench however is not able to change the setting of the torque wrench. Furthermore he can also not observe the precise value of the torque applied. From the limited possibility of indication, he can merely note whether the torque applied lies within the desired range (is "good") or not. A further development provides that the torque wrench have a changeable wrench identification and that a change in the wrench identification is possible only via the attachable programming device. By this identification of the wrench, a large number of wrenches can also be distinguished from each other by the programming device and checked afterwards in a manufacturing operation with respect to the torques produced, in the manner that the torque values stored in the memory of the wrench are read and the readings thus obtained are evaluated in conjunction with the known place of use or the known sequence of use of the wrenches. In the case of such a torque wrench, it must, in principle, also be possible to calibrate them, i.e. have the stored and subsequently indicated values agree with the real values desired. It is furthermore preferred within the scope of the invention that such calibration can be effected merely by a programming device or some other control unit which is first separately attached to the torque wrench. Due to the above-mentioned possibility of storing the measured values in the torque wrench and the possibility of fixing the calibration values and the identification number, which is also, for instance, deposited as electronic code in a memory of the wrench, it is possible—during normal operation, during a normal work sequence—to use the torque wrench without the control unit or programming device. The user cannot in any way change these settings. In order to indicate whether a torque which has been applied is within the desired range, two light-emitting diodes of different color are preferably provided. For instance, a green light-emitting diode which lights up when the desired torque range has been reached and a red light-emitting diode lights up when this range has been exceeded. For the simplest possible operation of the torque wrench, it is furthermore preferred that only one actuating button is arranged on the torque wrench in order to actuate its electronics. When a torque is applied and the green light-emitting diode for instance lights up then the instantaneous value, which cannot be known precisely by the user, can be stored by means of the actuating button. This storing then takes place by an acknowledgement by depression of the actuating button. The measured, possibly provisionally stored value of the torque applied is then stored in the measured value memory. Due to the above-described functions of the electronics, it is even possible to preprogram different ranges within a predetermined work cycle for the torque to be applied. It is furthermore preferred to arrange the entire above-described electronics in the region of the handle of the torque wrench, which is preferably hollow. Therefore, there is no difference in external appearance from that of an ordinary torque wrench, with the exception of an interface provided in the handle region, preferably at its end, in order to establish a connection to the programming device and with the exception of the two or three light-emitting diodes and the actuating button. The electronic circuit can be developed as a microprocessor which cooperates with memory elements and operates in accordance with a predetermined program which can be stored for instance in a ROM of the wrench. The memory, which is a semiconductor memory, is preferably of such size that a large number of measured values can be stored simultaneously. A battery can be used as power supply. In order to be able to achieve even more precise identification, it is possible to associate the measured values with the time of day. When the measured values are printed out, the minimum and the maximum values are indicated together with the corresponding time of day. A structurally favorable development of the torque wrench consists in equipping the tube with a handle which, in the direction towards the other end of the tube, continues into a tongue which receives both the light-emitting diodes and the actuating button. In this way, a protected arrangement, in particular of the light-emitting diodes, can be achieved. It is proposed in this connection to adapt the tongue to the curvature of the tube and to widen it starting from the tip of the tongue in the direction towards the handle. As an alternative, light-emitting rings can also be used for easier recognition.

BRIEF DESCRIPTION OF THE DRAWINGS

The invention will be explained in further detail with reference to the accompanying drawing which, however merely shows one illustrative example. In the drawing

DETAILED DESCRIPTION OF THE PREFERRED EMBODIMENTS

Figure 1:
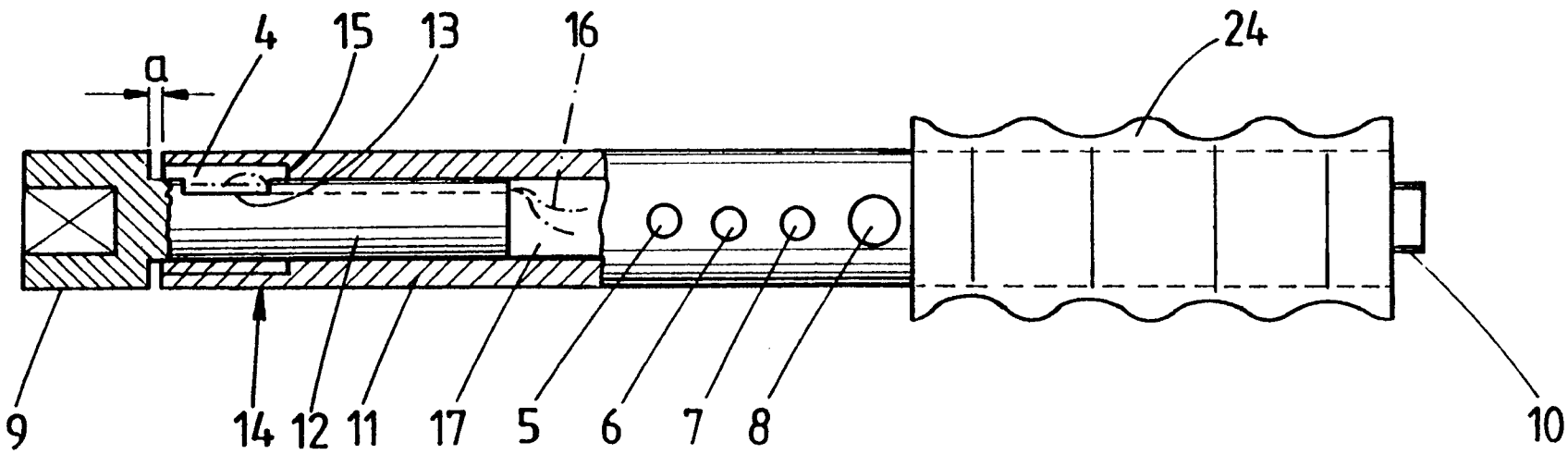
FIG. 1 is a side view of a torque wrench in a first embodiment.

There is shown and described a torque wrench 1 or 2 (see FIG. 3) having an electronic measuring device which detects the prevailing torque by means of strain gauges 4. In a manner known per se, the strain gauges 4 are connected in a bridge circuit, for instance in a known Wheatstone bridge.

The torque detected via the strain gauges 4 is stored in a memory provided in the electronics. There is furthermore provided an indicating device in the form of light-emitting diodes 5, 6, 7 which serve to indicate the minimum and maximum values reached.

When a measurement is carried out, the light-emitting diode 7, for instance, flashes first, upon application of load. This merely serves to indicate that a load is present. This light-emitting diode can also be provided with a color, for instance, yellow. It lights up continuously when the actual torque is a certain percentage below the minimum value. This percentage can be freely selected by the operator. Upon increasing load, the lower limit of the previously set range for the torque to be applied has been reached. When this lower limit is exceeded, the diode 6 which has been provided with the color green lights up. If the force is then increased still further and the upper limit of the permissible torque is for instance exceeded, the light-emitting diode 5, which has been given the color red, is lit up continuously. The user is thus advised that he must reduce the force applied or unscrew the screw in order again to reach the permissible range of the torque. The value of the torque applied upon the actuation is still available after the actuation, for instance in an intermediate storage.

A torque applied in this manner is then stored by actuating the push button 8. The actuating button 8 must be positively actuated by the user of the torque wrench. After storage, the torque wrench is ready for the next actuation and storage. If it is contemplated to execute in succession a cycle of several torque values which are also different from each other, then the wrench is set to the next following value by the electronic circuit which can for instance be a programmed microprocessor.

An interface 10 is developed at the end opposite the front wrench head 9. A connection to an evaluation device, which will be explained in detail further below with reference to FIG. 4, can be attached to said interface 10.

It is furthermore proposed that a wrench identification be stored in the circuit of the torque wrench and that a change in the wrench identification can be effected only upon connection to a separate programming device. The electronic circuit cooperates with the programming device for the transmission of the stored measured values, the reading of the wrench identification, and the setting of new values and the programming.

It is also clear from the above explanation that a measured torque can be indicated only with respect to the reaching or exceeding of the previously set torque range. A digital, continuous indication of the instantaneous torque prevailing is not contemplated.

It is furthermore proposed that the torque wrench can be calibrated only upon connection to the separate programming device. The signal produced by the strain gauge 4 can be associated with a real known torque, compared with it and set only upon connection to the separate programming device.

The sole actuating button 8 which is provided, is sufficient for the entire actuation of the torque wrench. In principle, such a development can be selected that the torque wrench can be turned on and off by said actuating button 8. It can, in addition, also be provided that, as is known per se for electronic apparatus, off-position switching is developed, i.e. that the device turns itself off automatically if no activity occurs for a given, predetermined period of time.

It is furthermore essential that the entire electronics be arranged within a tube 11 of the torque wrench. The memories are preferably developed as static semiconductor chips and cooperate with an electronic network of the wrench which also takes care of the communication with the programming device. The customary dimensions known from mechanical torque wrenches are therefore not increased by the electronics. The tube 11 contains in its forward region a lever 12 on which the string gauges 4 are seated. The lever 12 is for this purpose bevelled flat at 13 in order to obtain a surface for the attachment of the strain gauges 4.

Furthermore, the tube 11 is bored out in its forward region 14 so that an inner step 15 results. As a result of this step 15, the tube surrounds the lever 12 with lateral clearance in the region of the strain gauges 4. Upon actuation of the torque wrench 1 or 2, the lever 12 can therefore bend in the front region 14 of the tube 11. At the end of the tube 11 there is also a distance a from a wrench head 9.

Connecting wires 16 extend from the strain gauges 4 into the inside 17 of the tube 11. The required electronic components and possibly also the power supply are arranged in the interior 17.

Figure 2:
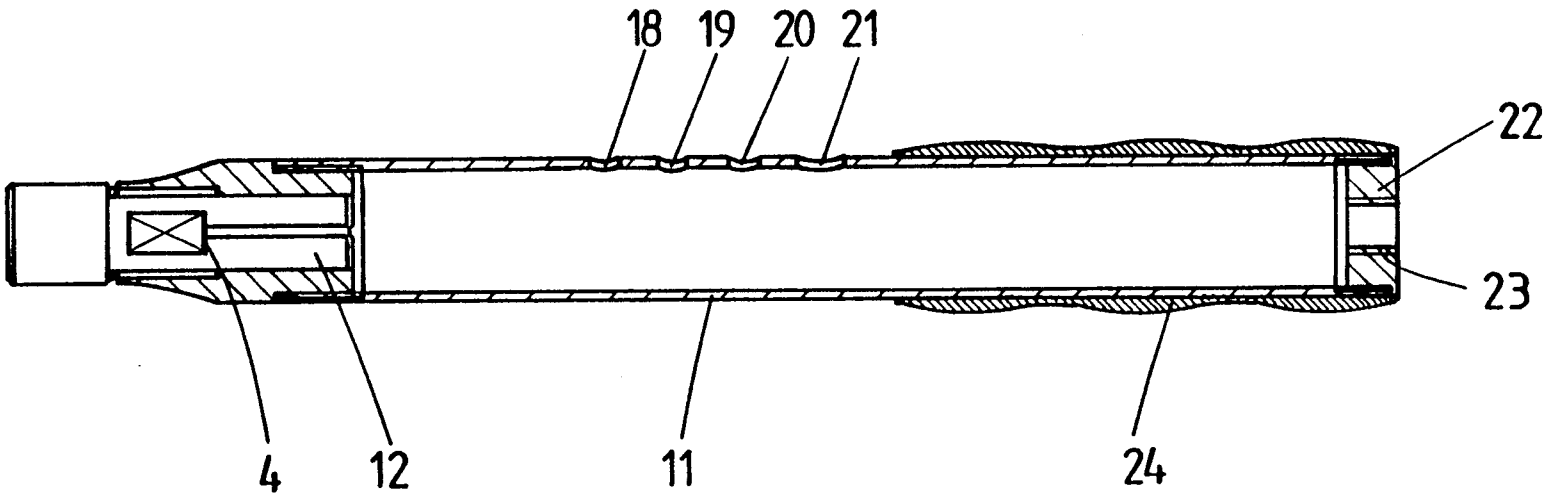
FIG. 2 shows the torque wrench of FIG. 1 in section, without electronics.

This construction of the torque wrench 1 or 2 can be noted more clearly from the sectional showing of FIG. 2. In that figure, the flattening 13 of the lever 12 is also clearly shown in a top view. Furthermore, the openings or holes 18–21 for the light-emitting diodes 5–8 in the tube 11 can be noted.

In the region of the rear end of the tube 11 which bears a handle 24 there is a closure 22 having a bore hole 23 in order to establish the interface 10 for connection to a programming device or some other data processing device.

In order to make it possible to grip the torque wrench securely upon working, the handle 24 is provided with a profiling.

Figure 3:
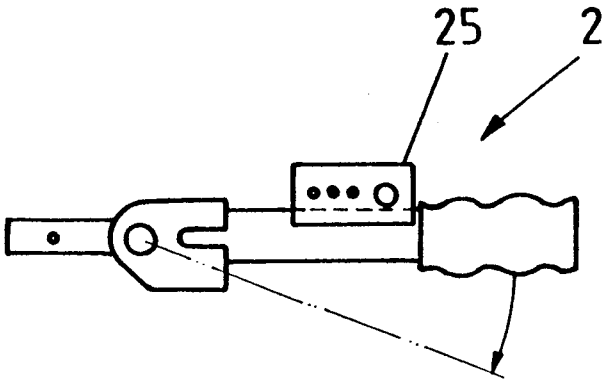
FIG. 3 shows a second embodiment of the torque wrench.

The torque wrench of FIG. 3 is a bendable torque wrench. It is, basically, constructed in the same way as the torque wrench 1.

However, in the torque wrench of FIG. 3, the indicating means, i.e. the light-emitting diodes 5–7 and the push button a, are arranged in a housing 25 extending above the tube 11.

Figure 4:
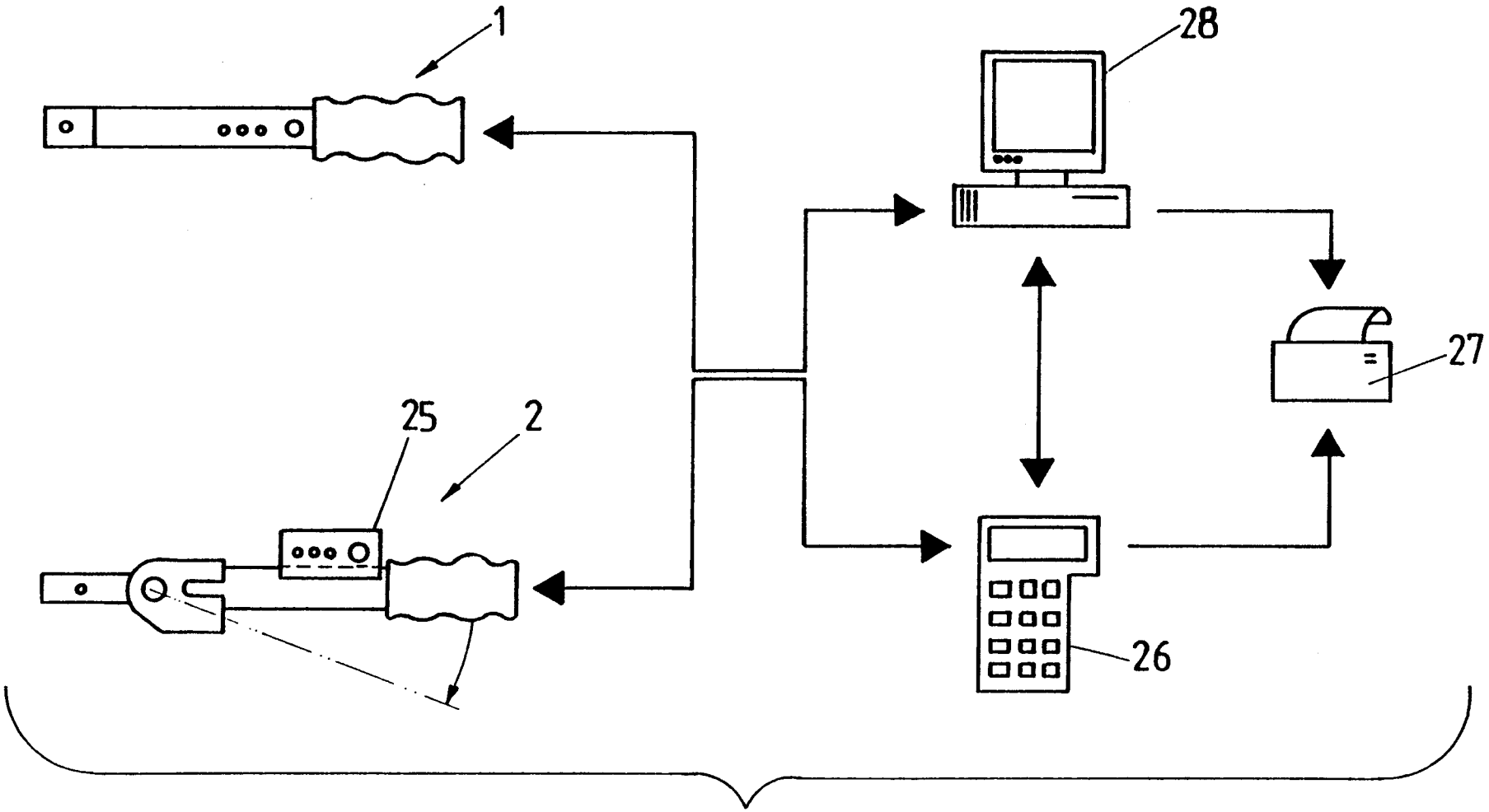
FIG. 4 shows programming and evaluation circuits for the torque wrench.

FIG. 4 shows the possible programming and the possible reading of the measured values. For this purpose a personal computer 28 or a portable programming device 26 is connected to the interface. The values can be printed out by means of a printer 27. By means of the programming devices 25 and 26, it is therefore possible both to read instantaneously measured torque values which have been stored over a work cycle and to impart a new program to the torque wrench 1 or 2. In addition, the torque ranges and the wrench identification can, for instance, be changed via the devices 25 and 26. Different torque ranges can also be established for a given work cycle. For instance, a torque range x for the first ten operations and a torque range y for the second ten operations.

Figure 5:
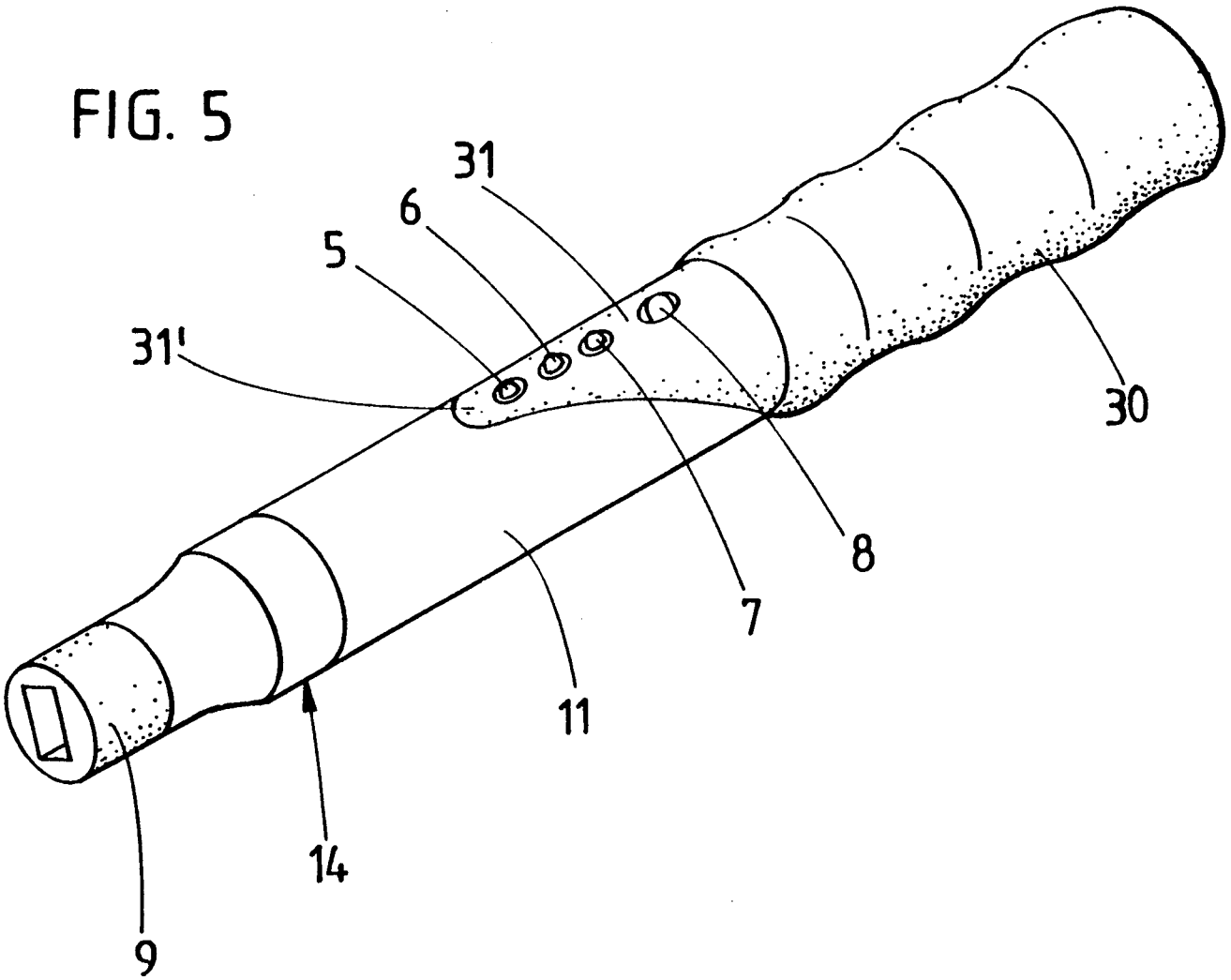
FIG. 5 shows, in perspective, a third embodiment of the torque wrench.

The third embodiment of the torque wrench, shown in FIG. 5, corresponds substantially to the first embodiment.

Differing from the first embodiment, the handle 30 fixed at the end of the tube 11 is continued by a tongue 31 in the direction towards the head end of the tube 11. This tongue serves to receive, arranged in a row, the light-emitting diodes 5, 6, 7 as well as the actuating button 8. The tongue 31 is adapted to the curvature of the tube 11 and widens, starting from the tip 31' of the tongue, in the direction towards the handle 30. Thus, the tongue 31 which protects the light-emitting diodes 5, 6, 7, forms in a certain sense a light-emitting bar.

Figure 6:
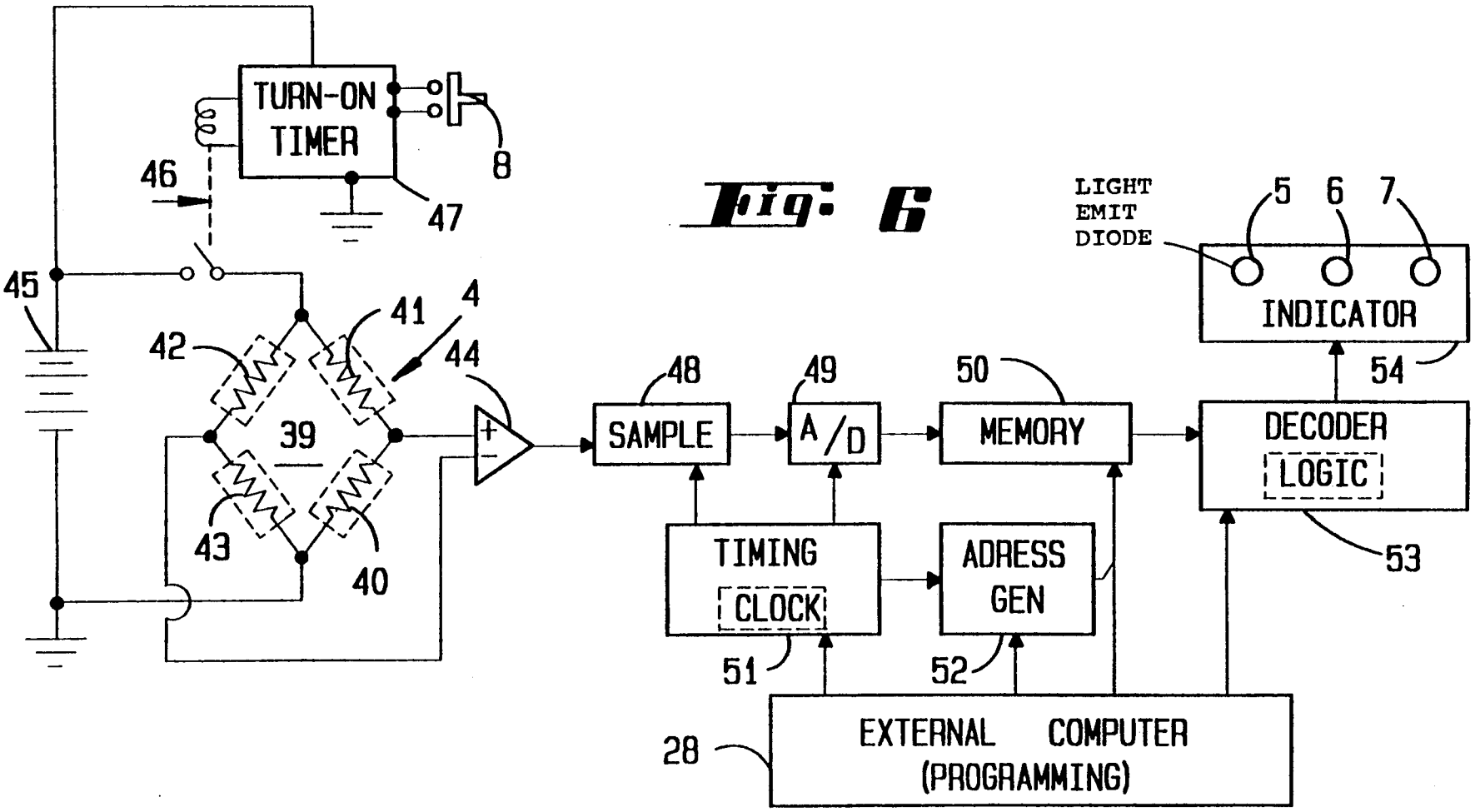
FIG. 6 is a circuit suitable for carrying out the invention.

FIG. 6 shows circuitry suitable for carrying out the invention. The strain gauges 4 comprise a Wheatstone bridge 39 of four strain-gauge resistive elements 40, 41, 42, and 43. An output signal from the bridge 39 is extracted by differential amplifier 44, and electric power for energizing the bridge 39 is provided by a battery 45 connected via a contact of relay 46 to the bridge 39. A turn-on timer 47 is powered by the battery 45, and is activated by operation of a switch of the push button 8. In response to a pushing of the button 8, the timer 47 energizes the coil of the relay 46 to close the relay contact for connection of the battery to the bridge 39 as well as to other components of the circuitry of FIG. 6, connections of the battery to the other components being omitted in the drawing to simplify the drawing.

A signal outputted by the amplifier 44 is sampled by sampler 48, converted to a digital quantity by analog-to-digital converter 49, and stored in a memory 50. A timing unit 51, which includes a clock, applies timing signals which strobe the sampler 48 and the converter 49, as well as a generator 52 which generates and applies addresses to the memory 50 for storage of strain gauge data. Signals are outputted from the memory 50 to a decoder 53 for driving an indicator 54 which includes the light-emitting diodes (LED) 5, 6 and 7. The decoder 53 includes logic for selecting one or more of the LEDs to be lit in response to stored strain gauge data. The external computer 28 may be provided with connections to the memory 50, the timing unit 51, the generator 52 and the decoder 53 to program the strain gauge circuit, and to place indentity of the torque wrench in the memory 50.

We claim:

1. A torque wrench comprising:

an electronic measuring device including strain gauges;

said strain gauges being operatively connected to the wrench, and said electronic measuring device providing measured values of torque by means of said strain gauges;

a memory for storing the measured values; and an indicating device connected to an output of said memory and for indicating minimum and maximum amounts of the measured values; and a button operative to actuate said measuring device and said memory for storing the measured values; and wherein the torque wrench is operable with a separate programming device and has a variable wrench identification; and a change in the wrench identification is effected by connection of said memory to said separate programming device.

2. A torque wrench according to claim 1, wherein said indicating device includes two light-emitting diodes of different color to provide the indication.

3. A torque wrench according to claim 1, wherein said button is a sole actuating button operative for actuating electronics of said electronic measuring device.

4. A torque wrench according to claim 1, wherein the torque wrench has a tubular part and electronic components of the wrench are enclosed by the tubular part.

5. A torque wrench according to claim 4, wherein said indicating device includes light-emitting diodes of different color; the torque wrench further comprising a handle disposed on one end of said tubular part and which continues in a direction towards a second end of the tubular part into a tongue, the tongue receiving said light-emitting diodes and said actuating button.

6. A torque wrench according to claim 5, wherein a configuration of said tongue conforms to the curvature of said tubular part and, starting from a tip of said tongue, widens in a direction towards said handle.

7. A torque wrench comprising:

an electronic measuring device including strain gauges;

said strain gauges being operatively connected to the wrench, and said electronic measuring device providing measured values of torque by means of said strain gauges;

a memory for storing the measured values; and an indicating device connected to an output of said memory and for indicating minimum and maximum amounts of the measured values; and a button operative to actuate said measuring device and said memory for storing the measured values; and wherein the torque wrench is operable with a separate programming device and can be calibrated by connection of said memory to said separate programming device.

8. A torque wrench according to claim 7, wherein said indicating device includes two light-emitting diodes of different color to provide the indication.

* * * * *